US007318385B2

(12) United States Patent
Derner

(10) Patent No.: US 7,318,385 B2
(45) Date of Patent: Jan. 15, 2008

(54) BOAT LIFT

(75) Inventor: Eric J. Derner, St. Peter, MN (US)

(73) Assignee: Derner Technologies, Inc., St. Peter, MN (US)

( * ) Notice: Subject to any disclaimer, the term of this patent is extended or adjusted under 35 U.S.C. 154(b) by 0 days.

(21) Appl. No.: 11/821,012

(22) Filed: Jun. 21, 2007

(65) Prior Publication Data

US 2007/0252123 A1 Nov. 1, 2007

Related U.S. Application Data

(62) Division of application No. 11/314,760, filed on Dec. 21, 2005, now Pat. No. 7,267,066.

(60) Provisional application No. 60/685,546, filed on May 27, 2005.

(51) Int. Cl.
*B63C 7/00* (2006.01)
*B63C 3/06* (2006.01)

(52) U.S. Cl. ..... 114/44; 405/3

(58) Field of Classification Search ..... 114/44; 405/3

See application file for complete search history.

(56) References Cited

U.S. PATENT DOCUMENTS 4,103,869 A * 8/1978 Mesny et al. ..... 254/425
5,184,914 A * 2/1993 Basta ..... 405/3
5,348,330 A * 9/1994 Few et al. ..... 280/475
5,482,401 A * 1/1996 Spisak ..... 405/3
5,501,428 A * 3/1996 Garceau ..... 254/424
5,558,034 A * 9/1996 Hodapp ..... 114/44
6,224,102 B1 * 5/2001 Nebel ..... 280/765.1
6,494,487 B1 * 12/2002 Nebel ..... 280/765.1
6,907,835 B1 * 6/2005 Derner et al. ..... 114/44
6,983,707 B2 * 1/2006 Derner et al. ..... 114/44
7,051,665 B2 * 5/2006 Derner et al. ..... 114/44
7,156,030 B2 * 1/2007 Derner et al. ..... 114/44
7,267,066 B2 * 9/2007 Derner ..... 114/48

* cited by examiner

*Primary Examiner*—Jesús D Sotelo
(74) *Attorney, Agent, or Firm*—Dicke, Billig & Czaja, PLLC

(57) ABSTRACT

The pontoon boat lift system comprises a plurality of lifts. Each lift is comprised of a channel that mounts to deck support members of the boat. One end of a leg is pivotally mounted to one end of the channel. A screw supported in the channel is turned by a connection to an electric motor. A threaded follower on the screw travels along the screw when it is rotated by the motor. A fulcrum arm connects between the threaded follower and the leg to transmit a longitudinal movement of the follower into a pivotal movement of the leg. The leg is thus moveable between a raised and a lowered position. A base pad connected to the opposite end of the leg comprises a plurality of spaced support surfaces that contact the bottom of a body of water. The base pad supports the leg on the bottom of the body of water and easily separates from the bottom when the leg is moved to the raised position. The operation of the lifts is coordinated to raise the pontoon boat above the surface of the water at desired shoreline locations.

11 Claims, 17 Drawing Sheets

BOAT LIFT

CROSS-REFERENCE TO RELATED APPLICATIONS

This is a division of U.S. patent application Ser. No. 11/314,760, filed Dec. 21, 2005 now U.S. Pat. No. 7,267,066, which claimed priority from U.S. Provisional Patent Application No. 60/685,546, filed May 27, 2005.

BACKGROUND OF THE INVENTION

The present invention generally relates to a lift system for watercraft. In particular, the present invention relates to a portable lift system for a pontoon boat that is carried beneath a deck of the pontoon boat.

It is desirable to lift pontoon boats out of the water when not in use so that the pontoons are not continually exposed to the water and to avoid disruption to the boat or its occupants as a result of waves or wakes from other passing watercraft. Conventional pontoon boat lifts are well known, but are stationary, i.e. typically adjacent to a dock, and include a platform which is submersible under the water below the pontoon boat. With the pontoon boat positioned above the platform, the platform is raised to elevate the pontoon boat above the water. To avoid damage during sub-freezing weather, docks and conventional lifts must be removed from the water before it freezes, usually well before the end of a normal boating season. Also, the effectiveness of conventional lifts can be impacted by fluctuations in the water level of a lake.

Thus, there is a need in the art for a portable lift system for pontoon boats that allows a pontoon boat to be lifted and securely held out of the water at any desired location.

BRIEF SUMMARY OF THE INVENTION

The present invention is an improvement for a lift for a boat having a plurality of deck support members supporting a base of the boat, a pair of channels for connection to the plurality of deck support members, a power source located at a first end of the pair of channels, a bearing located at a second end of the pair of channels, a screw supported between the pair of channels, the screw having opposing first and second ends respectively connected to the power source and the bearing, a threaded follower located on the screw between the power source and the bearing, a leg connected to the pair of channels adjacent one of the first and second ends of the pair of channels, and a fulcrum arm connected between the threaded follower and the leg. The threaded follower comprises the improvement. The threaded follower comprises a block having a central opening extending between opposing first and second sides of the block. A threaded member has an outer surface configured to fit within the central opening. The threaded member has a bore, defined between first and second ends of the threaded member, that is configured with internal threads complimentary to the screw. The internal threads of the bore are mated with the screw. First and second end plates are connected to the opposing first and second sides of the block. Each of the first and second end plates is configured to define an opening. The screw extends through the openings of the first and second end plates. First and second wheels are mounted on posts connected to opposing third and fourth sides, respectively, of the block. The first and second wheels are positioned within the pair of channels.

DETAILED DESCRIPTION

Figure 1:
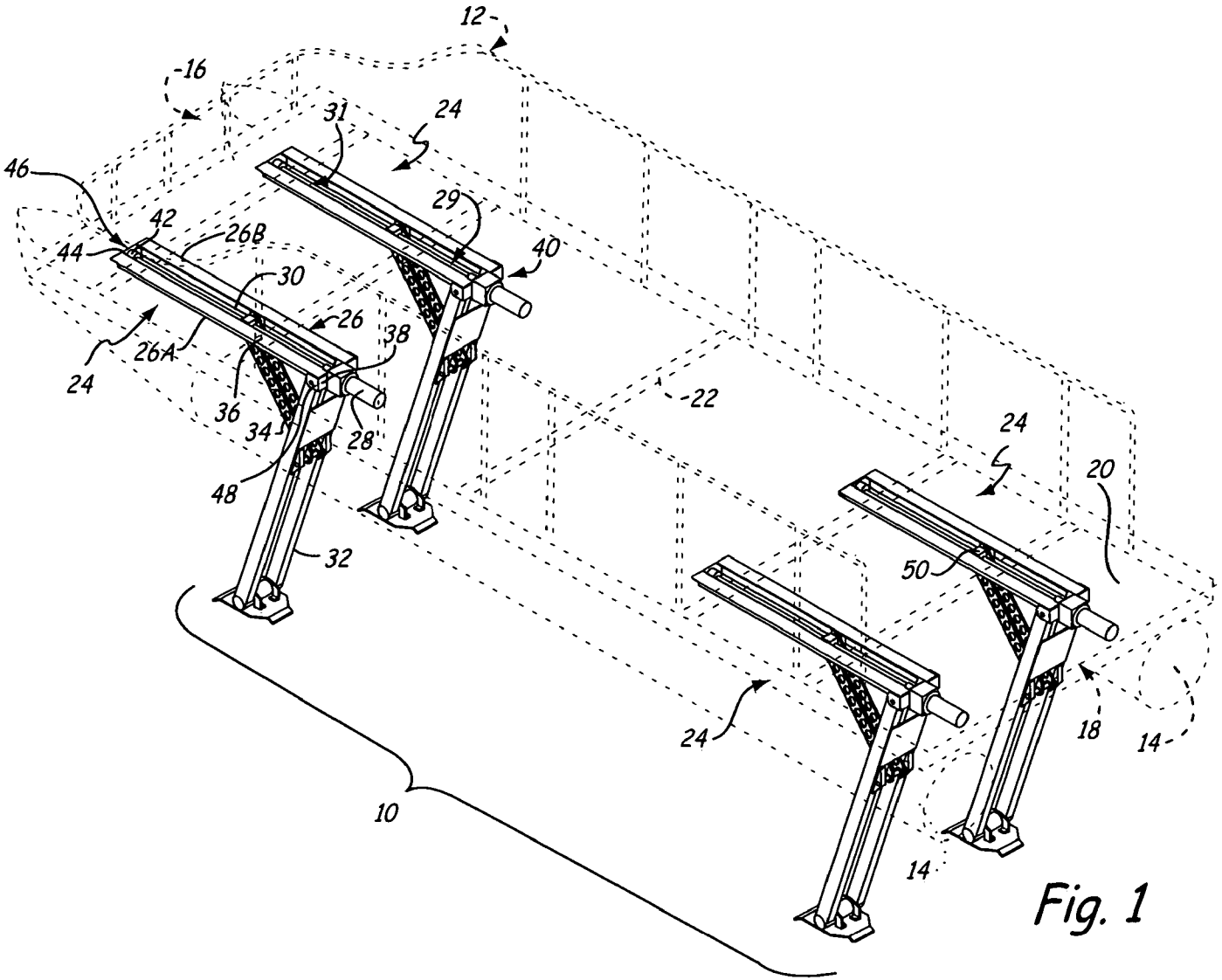
FIG. 1 is a perspective view of a pontoon boat in phantom showing the lift system of the present invention.

FIG. 1 is a perspective view of lift system 10 of the present invention mounted to a pontoon boat 12 (shown in phantom). Pontoon boat 12 generally comprises a pair of pontoons 14 placed parallel to one another and extending from a forward end 16 to a rearward end 18 of pontoon boat 12. A deck 20 is supported above pair of pontoons 14 by a plurality of spaced deck support members 22 that extend between pair of pontoons 14. Lift system 10 comprises four identical lifts 24 that are connectable to deck support members 22 of pontoon boat 12. Two lifts 24 are connected to deck support members 22 between pontoons 14 near forward end 16 of pontoon boat 12 and two lifts 24 are connected to deck support members 22 between pontoons 14 near rearward end 18 of pontoon boat 12. Each set of lifts 24 are oriented generally parallel to pontoons 14 and to each other.

Each lift 24 generally comprises a channel 26, a motor 28, a screw 30, a leg 32, and a fulcrum arm 34. Channel 26 comprises a pair of spaced channel members 26A, 26B. Each channel member 26A, 26B includes a flange 36 for mounting channel 26 to support members 22. A motor mounting plate 38 is welded to channel 26 at a first end 40. Motor 28 is mounted to motor mounting plate 38 and is connected to a first end 29 of screw 30. A second end 31 of screw 30 is supported by a bearing 42 secured to a bearing plate 44 welded to a second end 46 of channel 26. A leg 32 is pivotally connected to wings 48 of motor mounting plate 38. Leg 32 is pivoted by a fulcrum arm 34, which has one end connected to leg 32, and a second end connected to a threaded follower 50 that is threaded onto screw 30. Threaded follower moves along screw 30 when motor 28 turns screw 30. When screw 30 is turned in a first direction, leg 32 is extended by virtue of the fulcrum arm connection such that leg 32 is radially spaced from screw 30. When screw 30 is turned in a second direction, leg 32 is retracted by virtue of the fulcrum arm connection such that leg 32 is proximate to screw 30.

Figure 2:
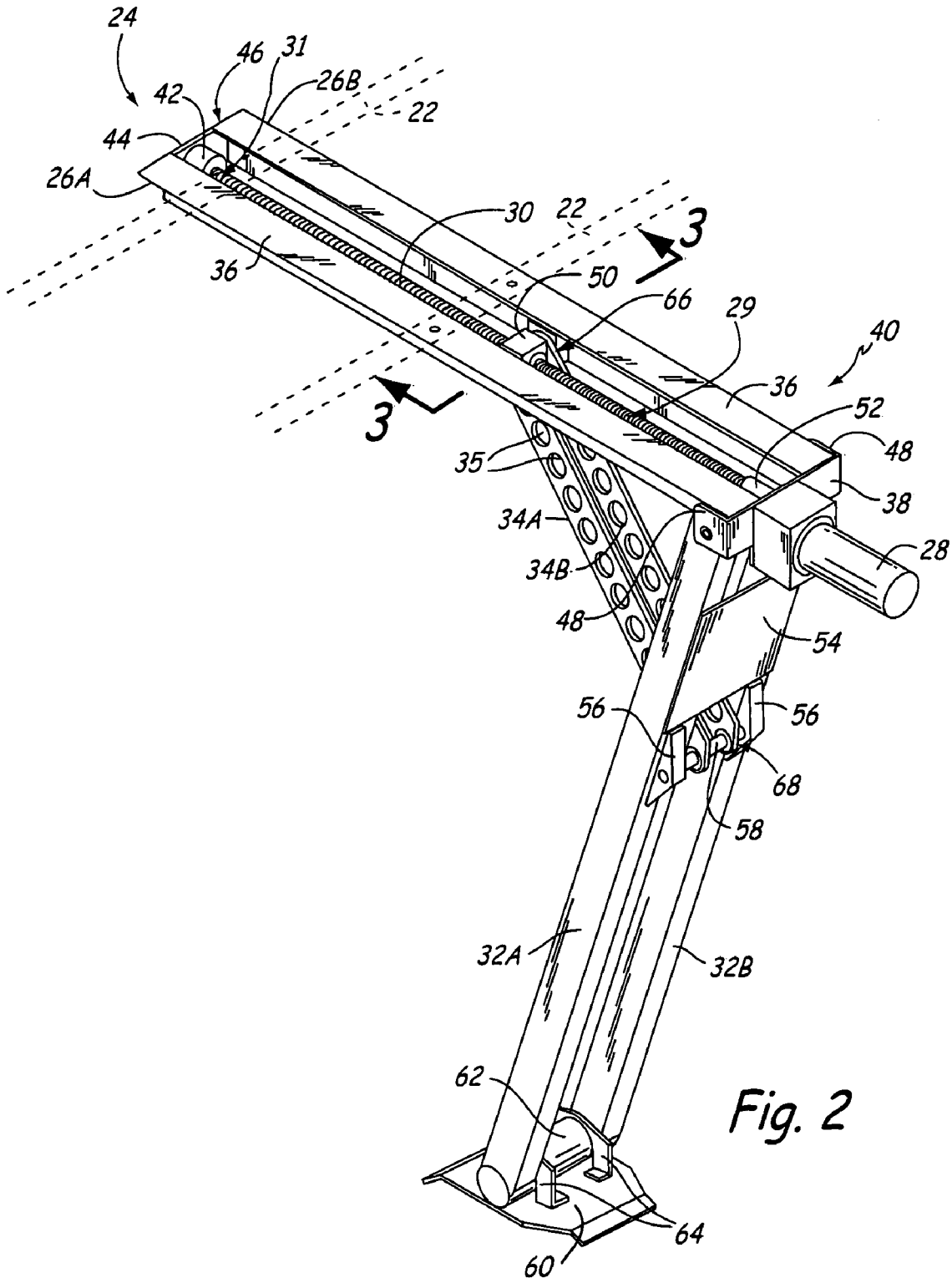
FIG. 2 is an enlarged perspective view of a lift of the present invention.

FIG. 2 is an enlarged perspective view of one of lifts 24 of lift system 10 shown in FIG. 1. Channel 26 serves to attach lift 24 to deck support members 22. Channel 26 is connectable to deck support members 22 by either preformed holes in flanges 36 of each channel member 26A, 26B or by drilling holes in flanges 36. Connection of lift 24 to pontoon boat 12 is accomplished by drilling complimentary holes in deck support members 22 and securing flanges 36 to deck support members 22 with bolts. Channel members 26A, 26B are located to define a space to house screw 30. Each channel member 26A, 26B serves as a track to assist in a smooth movement of threaded follower 50 along screw 30. Channel 26 has a length that spans several deck support members 22. Each channel member 26A, 26B has a length approximating leg 32, which in one embodiment is about 56.75 inches. The preferable material for channel members 26A, 26B is aluminum.

Motor 28 is operatively connected to screw 30 and turns screw 30 to raise and lower leg 32. Motor 28 is mounted to motor mounting plate 38, which is welded to first end 40 of channel 26. In one embodiment, motor 28 is a reversible electric motor. In a preferred embodiment, motor 28 is a one-half horsepower motor manufactured by Bodine Electric Company capable of providing 400 lb-in. of torque. Motor 28 is preferably coated by waterproofing material.

Screw 30 is housed between channel members 26A, 26B. First end 29 of screw 30 is operatively connected to motor 28 by a drive coupling 52. Second end 31 of screw 30 extends to second end 46 of channel 26 and is supported by bearing 42. In one embodiment, screw 30 has a length of about 54.78 inches and is a threaded 1-4 2 Start Acme screw having an outside diameter of approximately one inch.

Threaded follower 50 is located between first and second ends 29 and 31 of screw 30 and is threaded onto screw 30. Screw 30 guides threaded follower 50 along the length of channel 26 when screw 30 is turned by motor 28.

Leg 32 comprises a pair of leg members 32A, 32B which are pivotally connected to wings 48 of motor plate 38 at a first end of leg 32. A brace plate 54 is welded to leg members 32A, 32B adjacent the first end of leg 32 and serves to provide support and stability to leg members 32A, 32B as leg members 32A, 32B pivot about first end 40 of channel 26. Leg brackets 56 are connected to leg members 32A, 32B below brace plate 54 and support a pivot tube 58 for connection of fulcrum arm 34. Leg 32 has a length sufficient to raise pontoon boat 12 above the surface of the water when leg 32 is fully extended relative to channel 26. When leg 32 is extended, lift 24 is supported on the bottom of the body of water by a pad 60 pivotally connected to a second end of leg members 32A, 32B by a pad pivot tube 62 and pad brackets 64. In one embodiment, the length of leg members 32A, 32B is about 65.56 inches. The preferable material for leg members 32A, 32B is aluminum.

Fulcrum arm 34 serves to raise and lower leg 32 as threaded follower 50 travels along screw 30. First end 66 of fulcrum arm 34 is pivotally connected to threaded follower 50 and second end 68 of fulcrum arm 34 is pivotally connected to pivot tube 58. In one embodiment, fulcrum arm 34 comprises a pair of fulcrum arm members 34A, 34B. Each fulcrum arm member 34A, 34B includes a plurality of holes 35 equally spaced along the length of fulcrum arm member 34A, 34B for weight reduction. A cross-piece may optionally be welded between fulcrum arm members 34A, 34B to maintain fulcrum arm members 34A, 34B at a constant distance from each other when fulcrum arm members 34A, 34B are extending and retracting leg 32. Each fulcrum arm member 34A, 34B has a length sufficient to extend leg 32 such that leg 32 is generally normal to channel 26 when fully extended. In one embodiment, fulcrum arm members 34A, 34B have a length of about 30.64 inches and structure holes 35 have a diameter of 1.5 inches. Fulcrum arm members 34A, 34B are preferably formed from aluminum.

Figure 3:
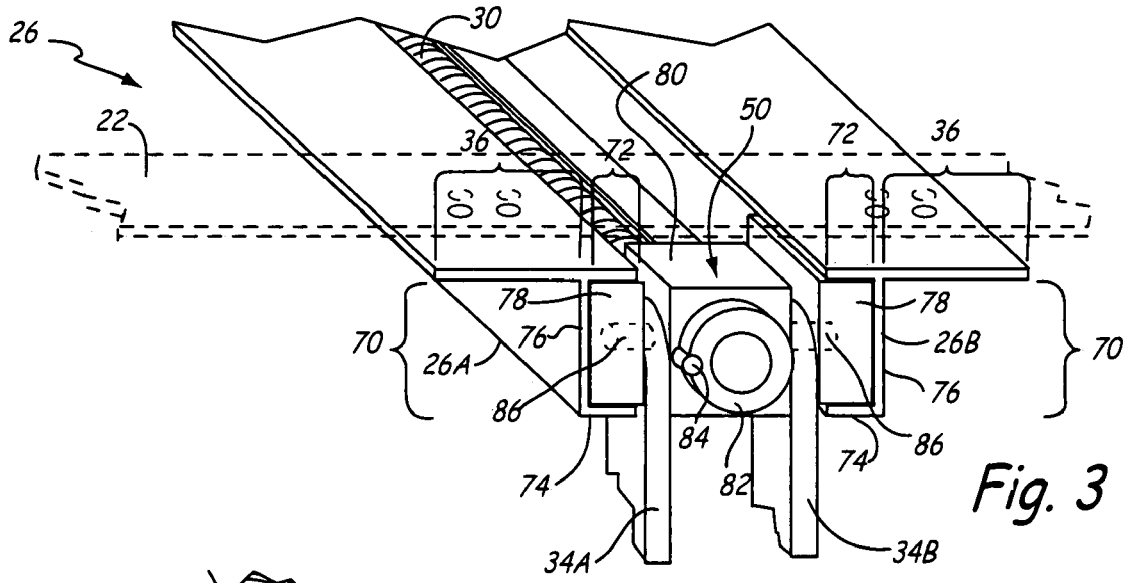
FIG. 3 is an enlarged cross-sectional view of the lift of FIG. 2 taken along line 3-3.

FIG. 3 is an enlarged cross-sectional view of channel 26 of FIG. 2 taken along line 3-3. Each channel member 26A, 26B is comprised of flange 36 and a C-shaped track 70 defined by a top wall 72, a bottom wall 74, and a vertical wall 76 that is normal to top wall 72 and bottom wall 74. Flange 36 and walls 72, 74, and 76 are integrally connected and formed by extruding aluminum. In one embodiment, flange 36 and walls 72, 74, and 76 have a wall thickness of about 0.1875 inches. Channel members 26A, 26B are spaced and oriented such that C-shaped track 70 of channel members 26A, 26B are oriented toward screw 30.

Slider blocks 78 are housed in C-shaped track 70 of channel members 26A, 26B and are dimensioned to slide along C-shaped tracks 70 as threaded follower 50 moves along screw 30 to assist in smooth travel of threaded follower 50 along screw 30. In one embodiment, slider blocks 78 are made of a polymer material, preferably plastic. In an alternative embodiment, slider blocks 78 can be replaced with wheels, bearings, or any other known structure that functions to provide a smooth travel of threaded follower 50 along screw 30.

Threaded follower 50 is threaded onto screw 30 between channel members 26A, 26B. Threaded follower 50 generally comprises a drive block 80, drive screw 82, and anchor pin 84. Drive block 80 and drive screw 82 are located on screw 30. Anchor pin 84 fixes drive screw 82 relative to drive block 80 to prevent drive screw 82 from rotating relative to drive block 80 when screw 30 is rotated. Drive block 80 includes posts 86 (shown in phantom) which extend from opposite sides of drive block 80 toward C-shaped tracks 70. Each post 86 serves to pivotally connect fulcrum arm members 34A, 34B to threaded follower 50, and to connect threaded follower 50 to slider blocks 78.

Figure 4:
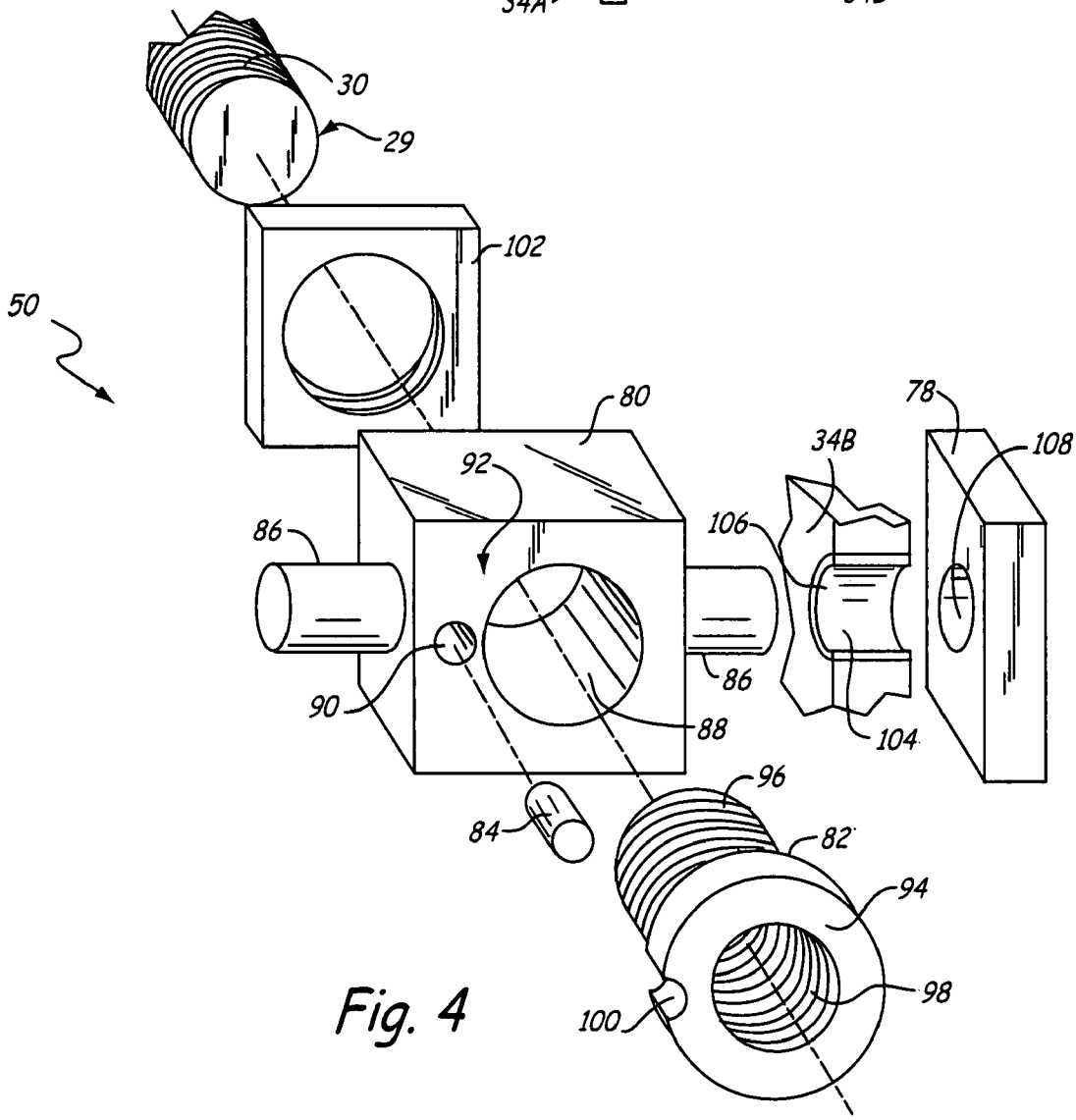
FIG. 4 is an exploded perspective view of a threaded follower of the lift of the present invention.

FIG. 4 is an exploded perspective view of threaded follower 50. As shown in FIG. 4, drive block 80 is an aluminum block with posts 86 extending from opposite sides oriented toward slider blocks 78. Each post 86 has a length sufficient to pass through fulcrum arm members 34A, 34B and connect drive block 80 to slider blocks 78. Drive block 80 also includes a smooth bore 88 that is axially aligned with screw 30. Bore 88 has a diameter that is larger than the outer diameter of screw 30. Drive block 80 further comprises a lock pin hole 90 located at side 92 of drive block 80 adjacent bore 88. Lock pin hole 90 has a depth and diameter sufficient to securely maintain a portion of anchor pin 84. Anchor pin 84 is sized such that anchor pin 84 is frictionally held in lock pin hole 90.

Drive screw 82 is comprised of a head 94, a tubular body 96, and a bore 98 extending therethrough. Head 94 has an outer diameter larger than that of tubular body 96 and includes a notch 100 at a circumferential edge of head 94. Body 96 of drive screw 82 has an outer diameter sized to fit within bore 88 of drive block 80 and a length sufficient to extend through bore 88 of drive block 80. Body 96 has external threads that mate with a drive nut 102 when body 96 extends through bore 88 to secure drive screw 82 relative to drive block 80. Bore 98 of drive screw 82 is provided with internal threads that mate with the external threads of screw 30.

Each fulcrum arm member 34A, 34B has an opening 104 which receives a brass bushing 106 that is dimensioned to fit onto posts 86 of drive block 80. Each slider block 78 is provided with a hole 108 to receive an end portion of posts 86.

To assemble threaded follower 50 on screw 30, channel members 26A, 26B are secured to deck support members 22 of pontoon boat 12 with screw 30 supported at one end by bearing 42. Before motor mounting plate 38 is welded to channel 26 and screw 30 is secured to coupler 52, drive nut 102 is slid onto first end 29 of screw 30. Fulcrum arm members 34A, 34B are then connected to drive block 80 by positioning brass bushings 106 over posts 86 and slider blocks 78 are positioned to allow posts 86 to extend within hole 108 of slider blocks 78. Next, slider blocks 78 are positioned within C-shaped tracks 70 of channel members 26A, 26B while bore 88 of drive block 80 is passed over first end 29 of the screw 30.

Drive screw 82 is then threaded onto first end 29 of the screw 30. Once drive screw 82 is at the desired location on screw 30, bore 88 of drive block 80 is positioned over body 96 of drive screw 82. Drive screw 82 is rotated until notch 100 of drive screw 82 is aligned with lock pin hole 90 of drive block 80 and anchor pin 84 is press fit into lock pin hole 90 with a portion extending to engage notch 100. Drive nut 102 is then threaded onto the end portion of body 96 of drive screw 82 that extends from bore 88 of drive block 80 to prevent axial movement of drive screw 82 relative to drive block 80.

Figure 5:
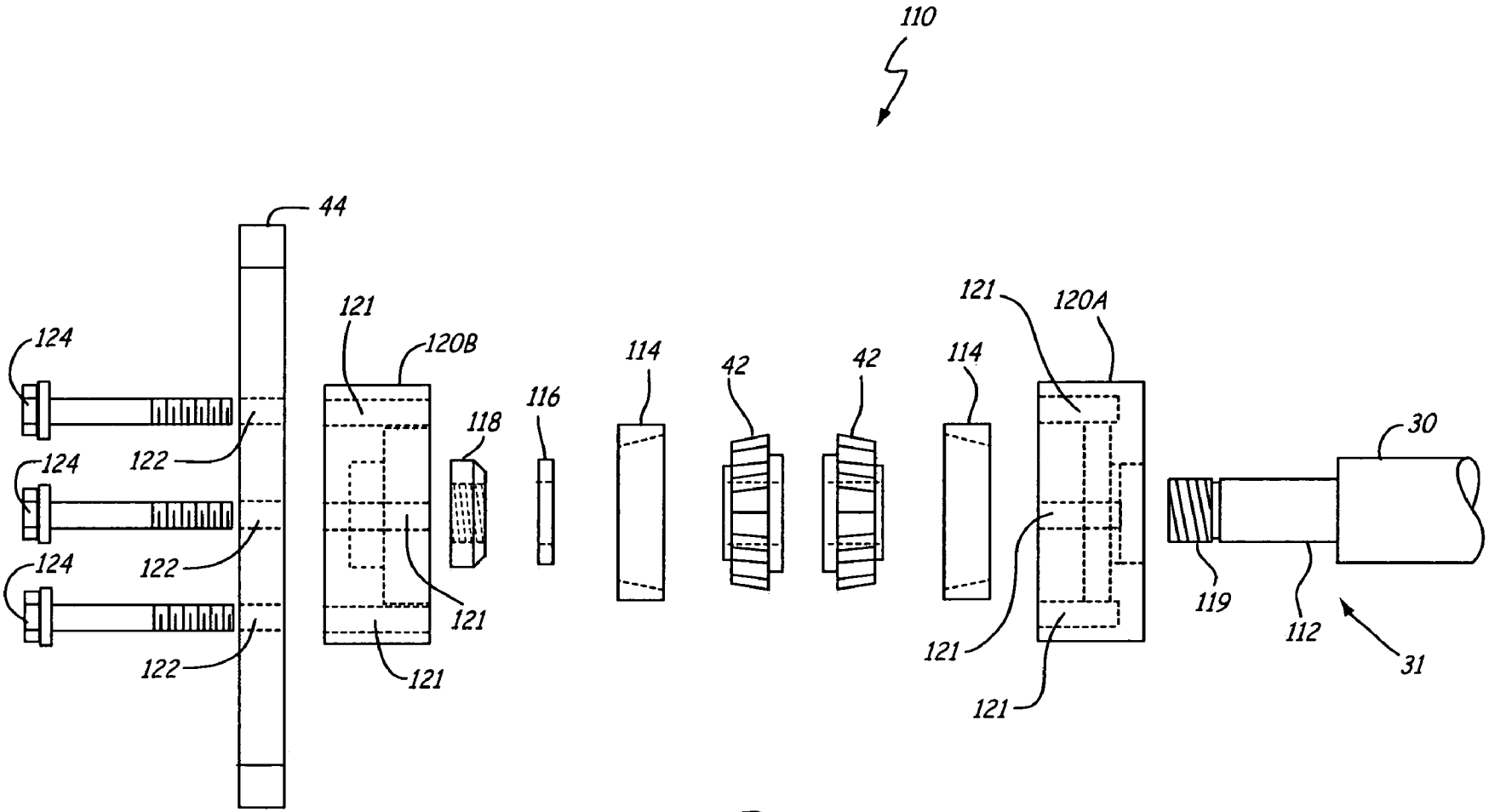
FIG. 5 is an exploded side view of a thrust bearing and housing for a screw of the lift of the present invention.

FIG. 5 is an exploded side view of bearing assembly 110 for supporting second end 31 of screw 30 relative to bearing mounting plate 44. As shown in FIG. 5, second end 31 of screw 30 is machined to define an end portion 112 of reduced diameter for mounting a pair of bearings 42. Each bearing 42 is housed in a bearing race 114 and is retained on the end portion 112 of screw 30 by a washer 116 and nut 118 that mates with a threaded end 119 of end portion 112. Bearing assembly 110 and second end 31 are covered by a bearing housing 120 consisting of facing cups 120A, 120B. Cups 120A, 120B are provided with a plurality of bores 121 that correspond to holes 122 in mounting plate 44. Bores 121 in cup 120A include internal threads which allow bearing housing 120 and bearing assembly 110 to be secured to mounting plate 44 by bolts 124.

Figure 6:
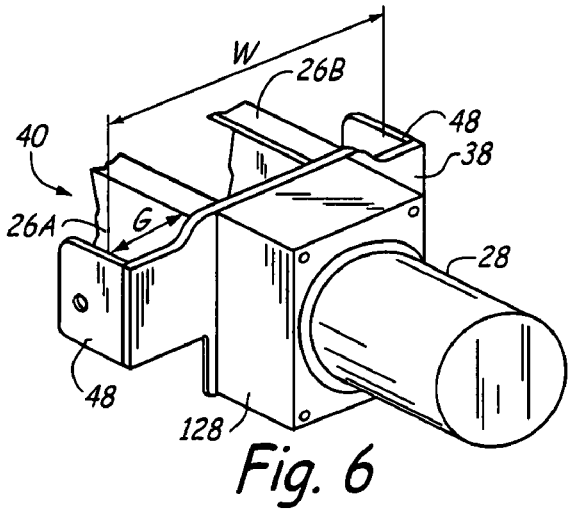
FIG. 6 is a perspective view of an electric motor mounting plate of the lift of the present invention.

FIG. 6 is a perspective view of first end 40 of channel 26 showing motor 28 mounted to motor mounting plate 38. As shown in FIG. 6, motor mounting plate 38 has a width W which is greater than the spacing of channel members 26A, 26B. As such, wings 48 are spaced from channel members 26A, 26B to create a gap G for mounting leg members 32A, 32B.

Figure 7:
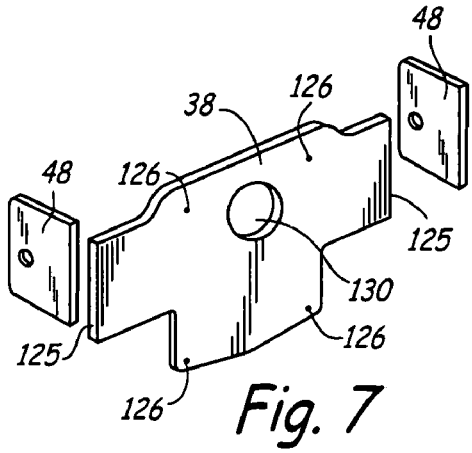
FIG. 7 is an exploded perspective view of one embodiment of the electric motor mounting plate of the lift of the present invention.

As shown in FIG. 7, in one embodiment wings 48 are welded to ends 125 of motor mounting plate 38. Alternatively, wings 48 may be integral to motor mounting plate 38 and are formed by bending end portions of motor mounting plate 38. As further shown in FIG. 7, motor mounting plate 38 is provided with motor mounting holes 126 which align with bolt holes in motor casing 128 (FIG. 6) for connecting motor 28 to motor mounting plate 38 with bolts. Motor mounting plate 38 also is provided with an opening 130 to permit a drive shaft of motor 28 to connect to screw 30.

Figure 8:
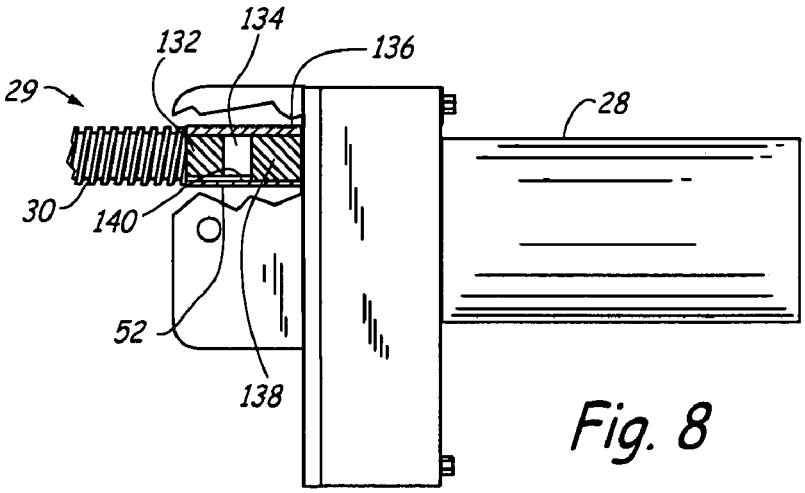
FIG. 8 is a side partially sectioned view of a screw/keyed motor shaft connection for the lift of the present invention.
Figure 8A:
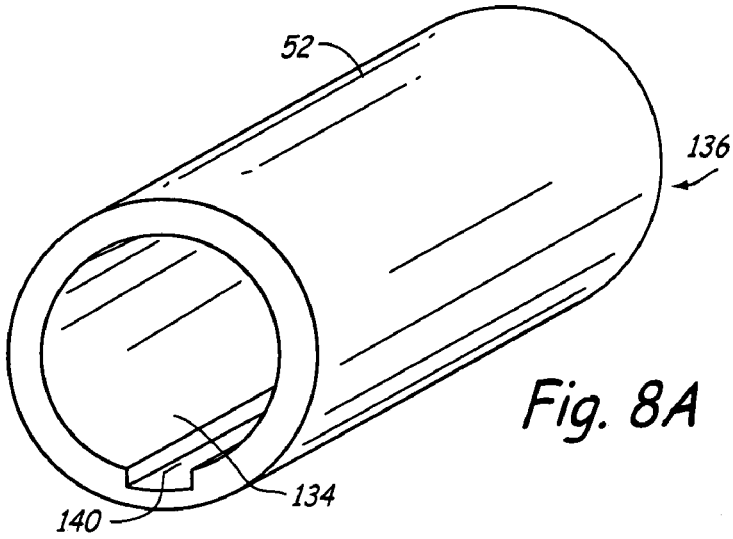
FIG. 8A is an enlarged perspective view of a coupler for connecting together the screw and the keyed motor shaft of FIG. 8.

FIG. 8 is a partial cutaway side view of first end 40 of channel 26 showing screw 30 connected to motor 28. As shown in FIG. 8, first end 29 of screw 30 is machined to define an end portion 132 of reduced diameter. End portion 132 is positioned within bore 134 of drive coupling 52 and is secured by welding. Second end 136 of drive coupling 52 is positioned over drive shaft 138 of motor 28. As shown in FIG. 8A, bore 134 of drive coupling 52 is configured with a key-slot 140 that extends along the inner circumference of drive coupling 52 along the length of bore 134. Referring to FIG. 8, drive shaft 138 of motor 28 is keyed to permit a portion of drive shaft 138 to extend into key-slot 140 at second end 136 of drive coupling 52 to allow motor 28 to rotate screw 30.

Figure 9:
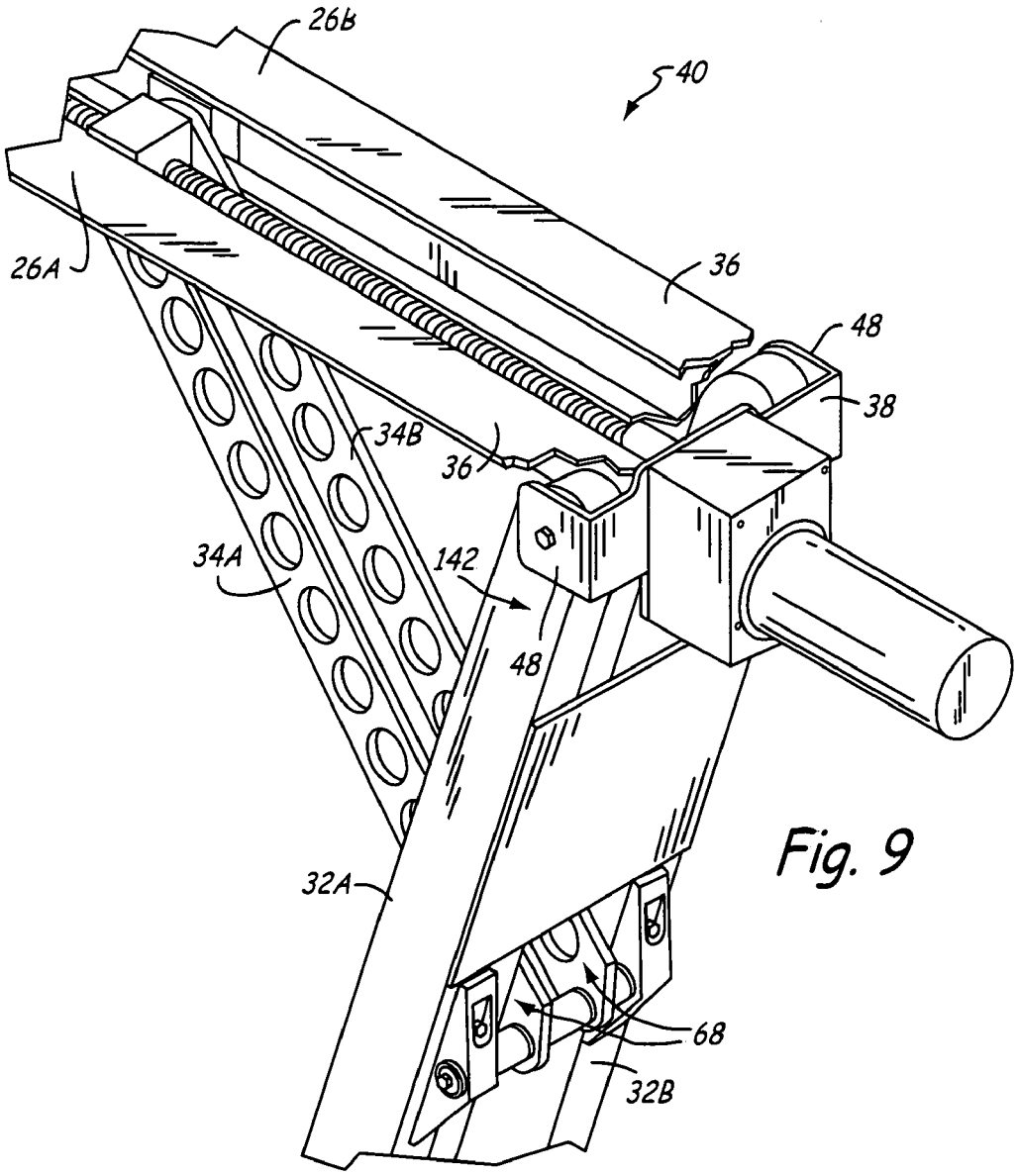
FIG. 9 is an enlarged perspective view of leg members connected to a second end of the pair of channels of the lift of the present invention.

FIG. 9 is an enlarged perspective view of first end 40 of channel 26. A portion of flange 36 is cut away to show a first end 142 of leg members 32A, 32B connected to wings 48 of motor mounting plate 38. As shown in FIG. 9, first end 142 of leg members 32A, 32B are mounted to wings 48 within gap G beneath flanges 36 of channel members 26A, 26B. First end 142 of leg members 32A, 32B are mounted to wings 48 by bolts to provide pivotal movement of leg members 32A, 32B relative to channel 26.

Figure 9A:
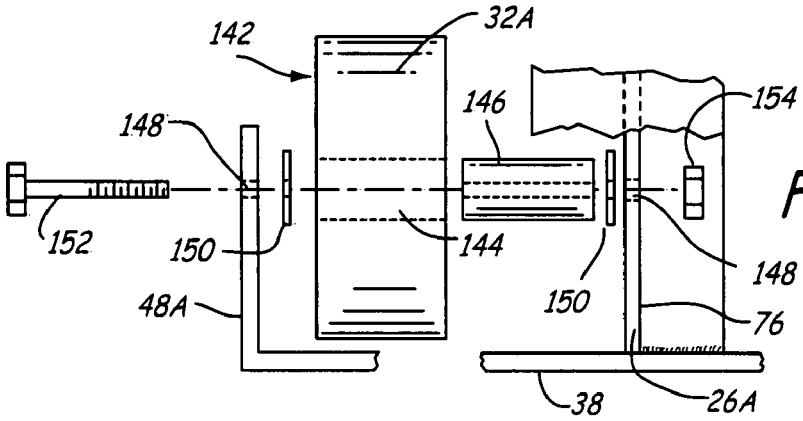
FIG. 9A is an exploded top view of the connection of one leg member to a wing of the electric motor mounting plate.

FIG. 9A is an exploded top view of first end 142 of leg member 32A between wing 48A and channel member 26A. As shown in FIG. 9A, first end 142 of leg member 32A has a hole 144, which receives a brass bushing 146. First end 142 of leg member 32A is axially aligned with pre-drilled holes 148 in wing 48A and in vertical wall 76 of channel member 26A. Washers 150 are aligned with holes 148 on either side of leg member 32A and leg member 32A is connected by bolt 152 and nut 154. First end 142 of leg member 32B connects to wing 48B and channel member 26B in an identical manner.

With leg members 32A, 32B mounted to wings 48 of motor mounting plate 38 and channel members 26A, 26B, second end 68 of fulcrum arm members 34A, 34B are pivotally connected to leg members 32A, 32B.

Figure 10:
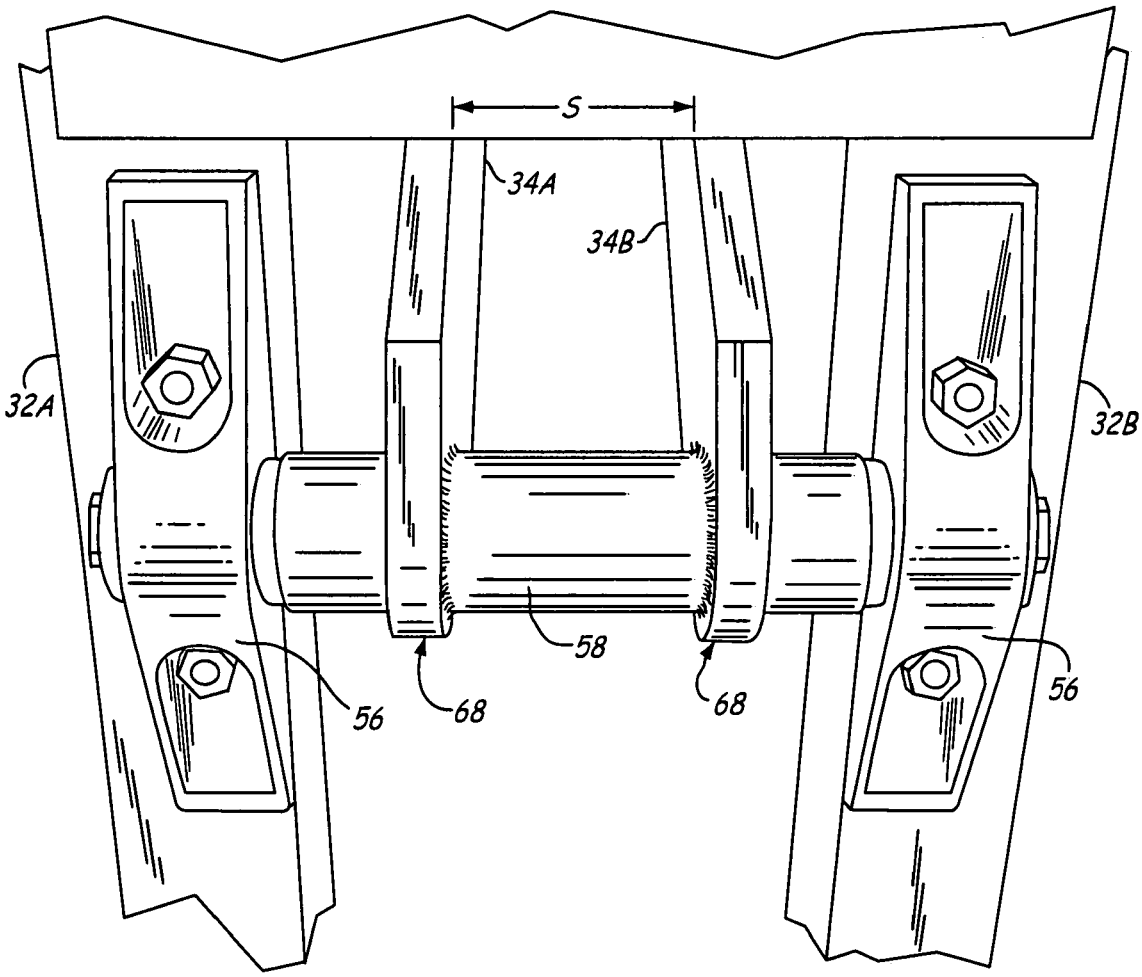
FIG. 10 is an enlarged rear perspective view of the connection of fulcrum arm members to leg members of the lift of the present invention.

FIG. 10 is an enlarged rear perspective view of second end 68 of fulcrum arm members 34A, 34B connected to leg members 32A, 32B. Second end 68 of each fulcrum arm member 34A, 34B has an opening (not shown) that receives pivot tube 58. Spacing S of fulcrum arm members 34A, 34B along pivot tube 58 is chosen to locate each fulcrum arm member 34A, 34B generally equidistant from a respective leg member 32A, 32B and to space fulcrum arm members 34A, 34B generally equal to the spacing of first end 66 of fulcrum arm members 34A, 34B. Once fulcrum arm members 34A, 34B are properly spaced along pivot tube 58, pivot tube 58 is welded to fulcrum arm members 34A, 34B. Pivot tube 58 has a length less than the distance between leg brackets 56 secured to leg members 32A, 32B to permit positioning of brass bushings 156 (not shown) at each end of pivot tube 58.

Figure 10A:
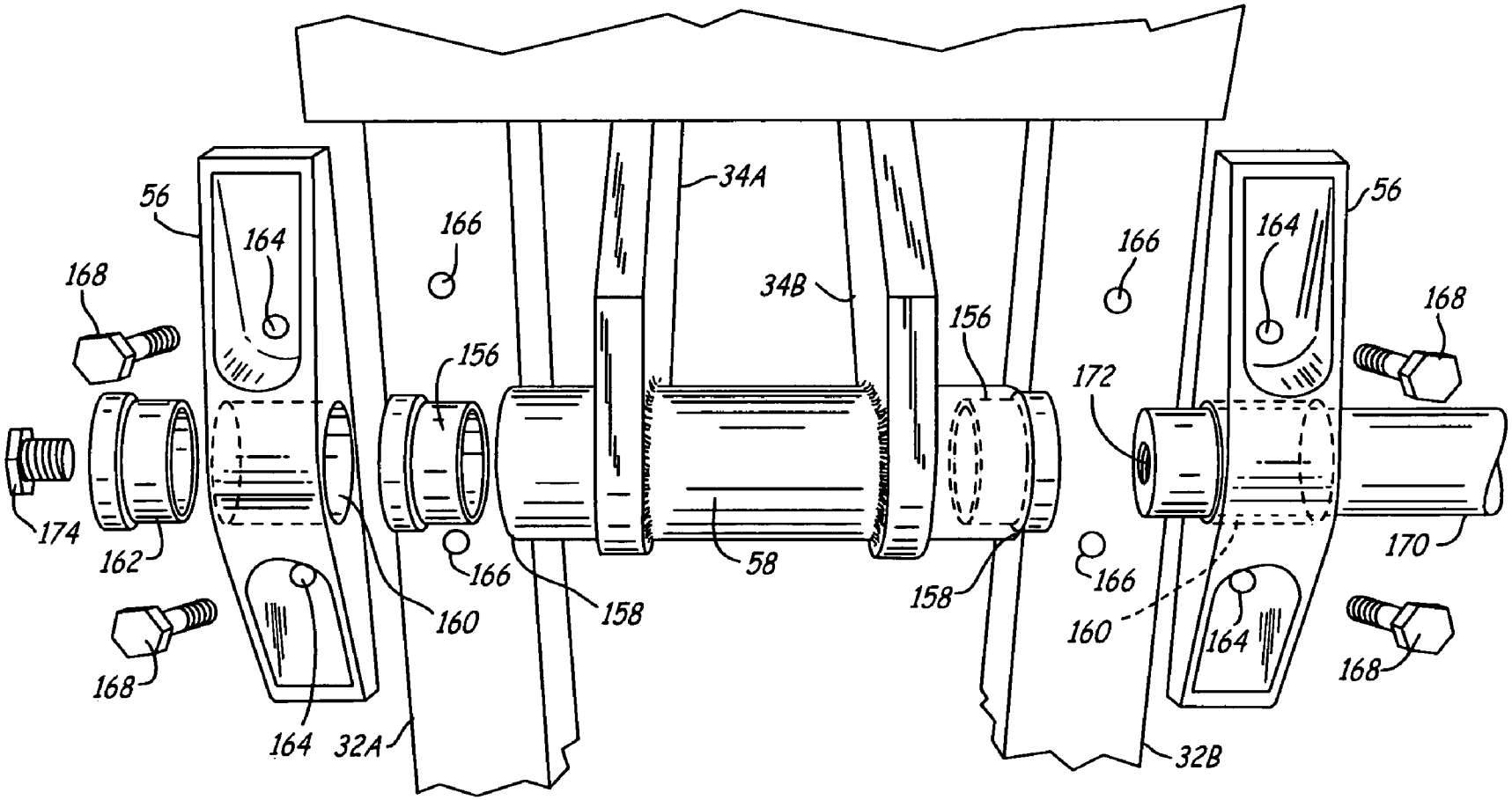
FIG. 10A is an exploded rear perspective view of the connection of fulcrum arm members to leg members of the lift of the present invention.

As shown in FIG. 10A, pivot tube 58 has openings 158 at first and second ends which receive a portion of a brass bushing 156 that is dimensioned to fit securely into openings 158.

Each bore 160 of leg brackets 56 receives a portion of brass bushing 162 at the outward facing side of leg brackets 56. Leg brackets 56 are mounted to leg members 32A, 32B by aligning holes 164 in leg brackets 56 with complimentary holes 166 in leg members 32A, 32B and connecting the leg brackets 56 with bolts 168. After leg brackets 56 are mounted to leg members 32A, 32B, openings 158 of pivot tube 58 and brass bushings 156 are aligned with bores 160 of leg brackets 56, and leg shaft 170 is passed axially through leg brackets 56 and pivot tube 58.

Leg shaft 170 has an outer diameter sized to fit within brass bushings 156 and 162 and a length sufficient to extend through leg brackets 56 and pivot tube 58. Each side of leg shaft 170 has a threaded hole 172 with a depth and diameter to receive threaded bolts 174 and thereby secure fulcrum arm members 34A, 34B to leg members 32A, 32B.

Figure 11:
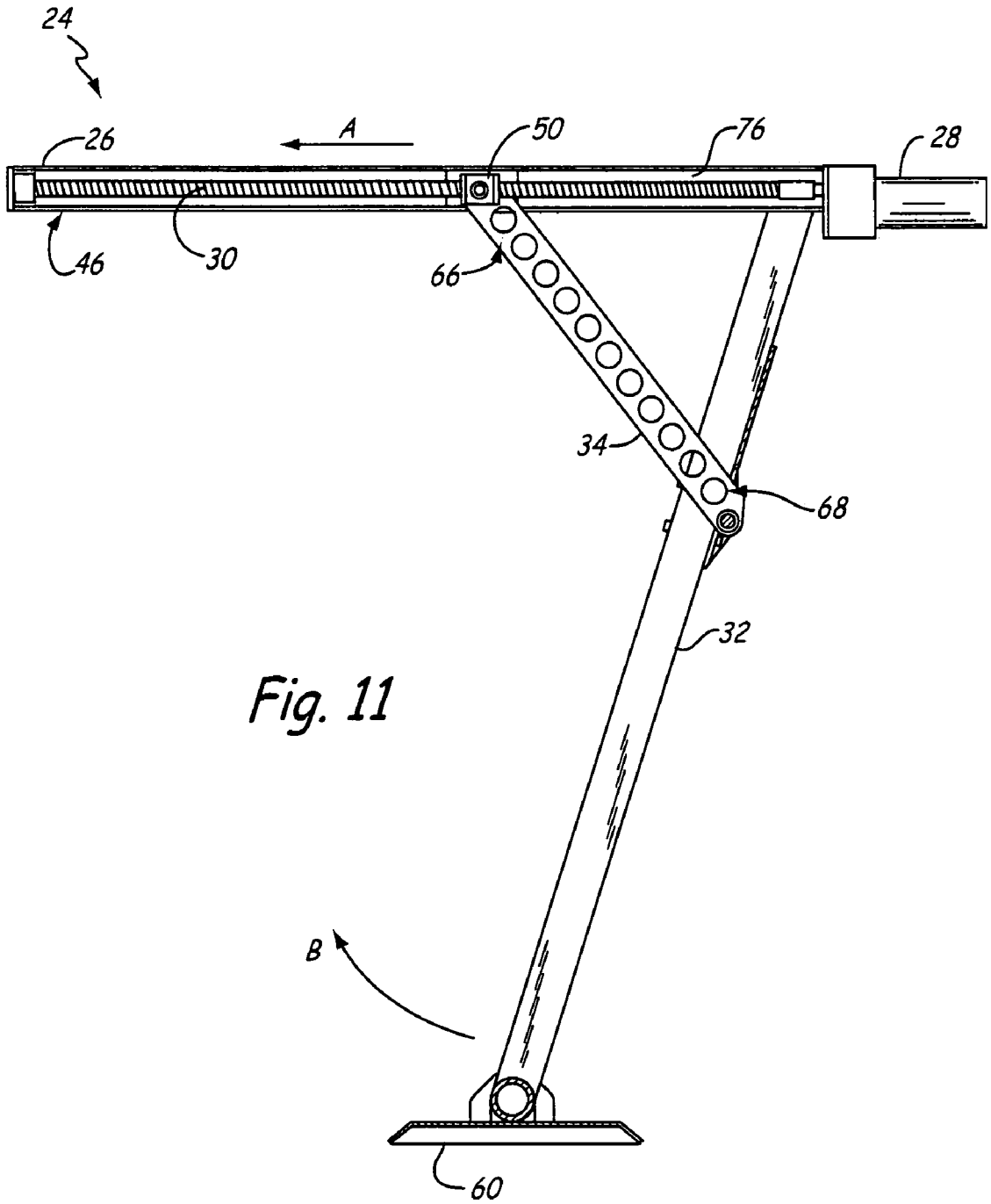
FIG. 11 is a partially sectioned side view of the lift of the present invention.

FIG. 11 is a partially sectioned side view of one of lifts 24 showing first and second ends 66 and 68 of fulcrum arm 34 connected to threaded follower 50 and leg 32, respectively. As motor 28 turns screw 30 in a first direction, threaded follower 50 carries first end 66 of fulcrum arm 34 along screw 30 in the direction of arrow A causing leg 32 to move in the direction of arrow B to a retracted position and stow leg 32 against channel 26. When leg members 32A, 32B are fully retracted, leg members 32A, 32B extend along the exterior side of vertical wall 76 of channel members 26A, 26B and pad 60 extends beyond second end 46 of channel 26.

To lower leg 32, motor 28 turns screw 30 in a second opposite direction and threaded follower 50 carries first end 66 of fulcrum arm 34 along screw 30 opposite the direction of arrow A to lower leg 32. Leg 32 is lowered until pad 60 contacts the bottom of the body of water. Operated in concert with a plurality of lifts 24, as shown in FIG. 1, as legs 32 of lifts 24 are further lowered, pontoon boat 12 is elevated above the surface of the body of water.

Figure 12:
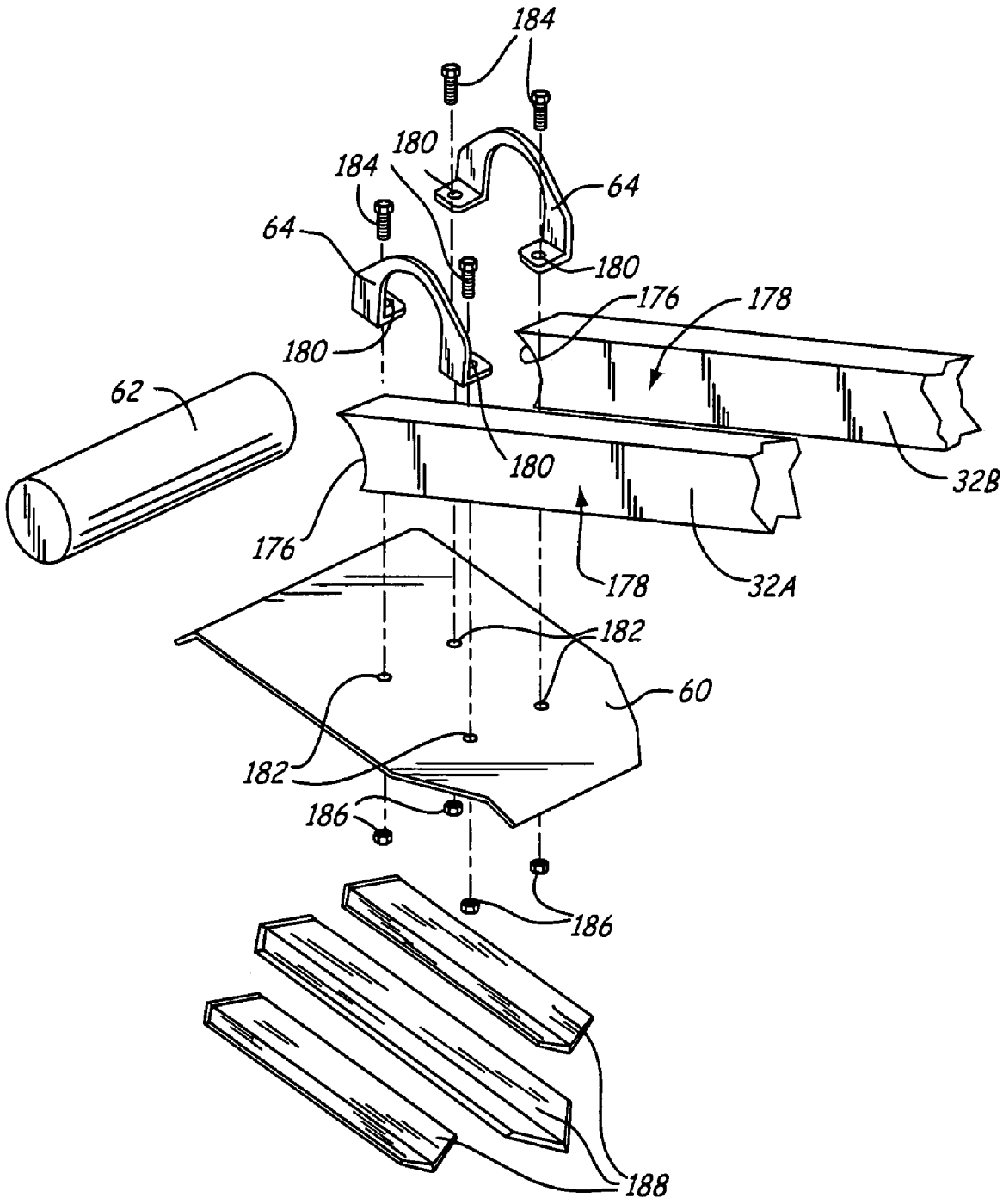
FIG. 12 is an exploded view of a pad of the lift of the present invention.

FIG. 12 is an exploded perspective view of one embodiment of pad 60. As shown in FIG. 12, end portion 176 of second end 178 of leg members 32A, 32B is curved to mate with pad pivot tube 62. End portion 176 of leg members 32A, 32B are spaced at opposite ends of pad pivot tube 62 and are secured by welding.

Pad 60 is pivotally connected to pad pivot tube 62 by a pair of U-shaped pad brackets 64 sized to fit over pad pivot tube 62. Pad brackets 64 are placed over pad pivot tube 62 adjacent to an inner side of leg members 32A, 32B. Holes 180 of pad brackets 64 align with corresponding holes 182 provided in pad 60 to pivotally connect pad 60 to pad brackets 64 with bolts 184 and nuts 186.

In one embodiment, pad 60 is formed of an aluminum plate and may include one or more support braces 188 welded to a bottom of pad 60. Support braces 188 shown in FIG. 12 comprise V-shaped aluminum pieces sized to fit bottom contours of pad 60.

Figure 13:
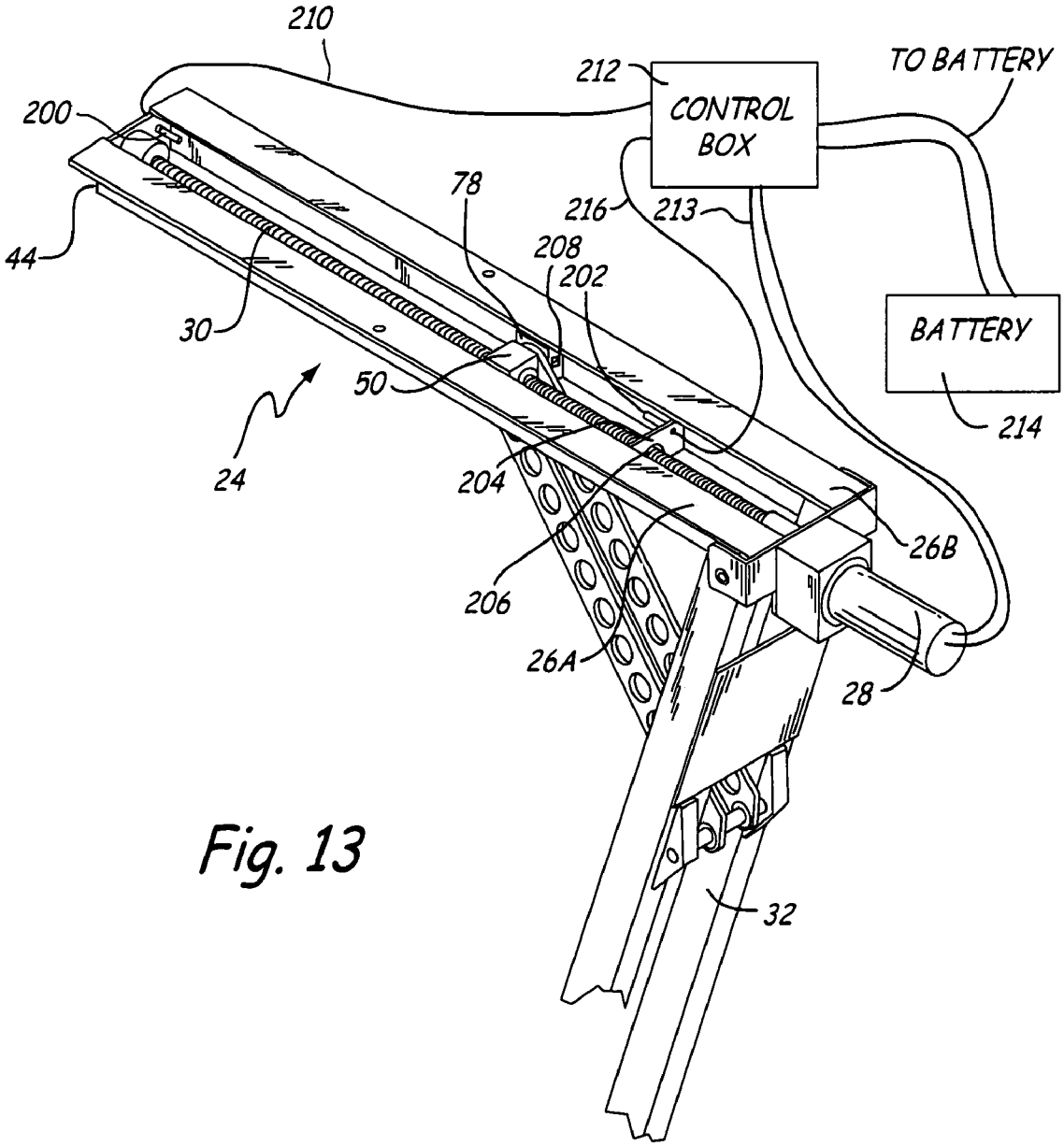
FIG. 13 is an enlarged partial perspective view of one embodiment of the lift of the present invention with stop sensors.

FIG. 13 is an enlarged partial perspective view of one of lifts 24 representing a control for synchronized operation of lift system 10. As shown in FIG. 13, in one embodiment of lift system 10, each lift 24 is equipped with a pair of spaced stop sensors 200 and 202, which aid in preventing motor 28 from being over-operated when leg 32 is in the complete up position or the complete extended position. Stop sensor 200 is connected to bearing mounting plate 44 and extends within channel 26 with an end oriented toward one of slider blocks 78. Stop sensor 202 is located on a plate 204, which is mounted within channel 26 between channel members 26A, 26B, such as by welding. Plate 204 is provided with a hole 206 that is sized to permit screw 30 to pass therethrough. Stop sensor 202 also has an end oriented to an opposite side of slider block 78.

In one embodiment, the leading and trailing faces of slider block 78 are provided with a magnet 208. As previously discussed, as threaded follower 50 travels along screw 30 toward bearing mounting plate 44, leg 32 is raised to a stowed position. When leg 32 reaches the raised, stowed position, magnet 208 on the leading face of slider block 78 is adjacent stop sensor 200. Stop sensor 200 senses the presence of the magnetic field and sends a representative signal via electrical connection 210 to a switch in control box 212, which opens an electrical connection 213 of motor 28 to battery 214. In alternative embodiments, stop sensor 200 may be positioned to correspond with a portion of leg 32 when leg 32 is in a raised, stowed position, with a magnet mounted on the corresponding portion of leg 32.

Likewise, as threaded follower 50 travels in an opposite direction along screw 30, leg 32 is lowered to engage a bottom of the body of water. In one embodiment, plate 204 with stop sensor 202 are located within channel 26 to ensure that leg 32 is not over-rotated and motor 28 is not over-operated. When threaded follower 50 is near plate 204 and magnet 208 on the trailing face of slider block 78 is adjacent stop sensor 202 a signal is transmitted via electrical connection 216 to a switch in control box 212 to open the electrical connection 213 of motor 28 to battery 214. In alternative embodiments, magnet 208 may be positioned on head 94 of drive screw 82 with corresponding stop sensor 202 positioned on plate 204 accordingly.

The remaining lifts 24 of lift system 10 are similarly electrically configured to control box 212. Control box 212 also receives inputs from a user and synchronizes operation of motors 28 of each lift 24 to raise and lower pontoon boat 12 relative to the surface of the water. Additionally, each motor 28 can be individually operated such as for leveling pontoon boat 12.

Figure 14:
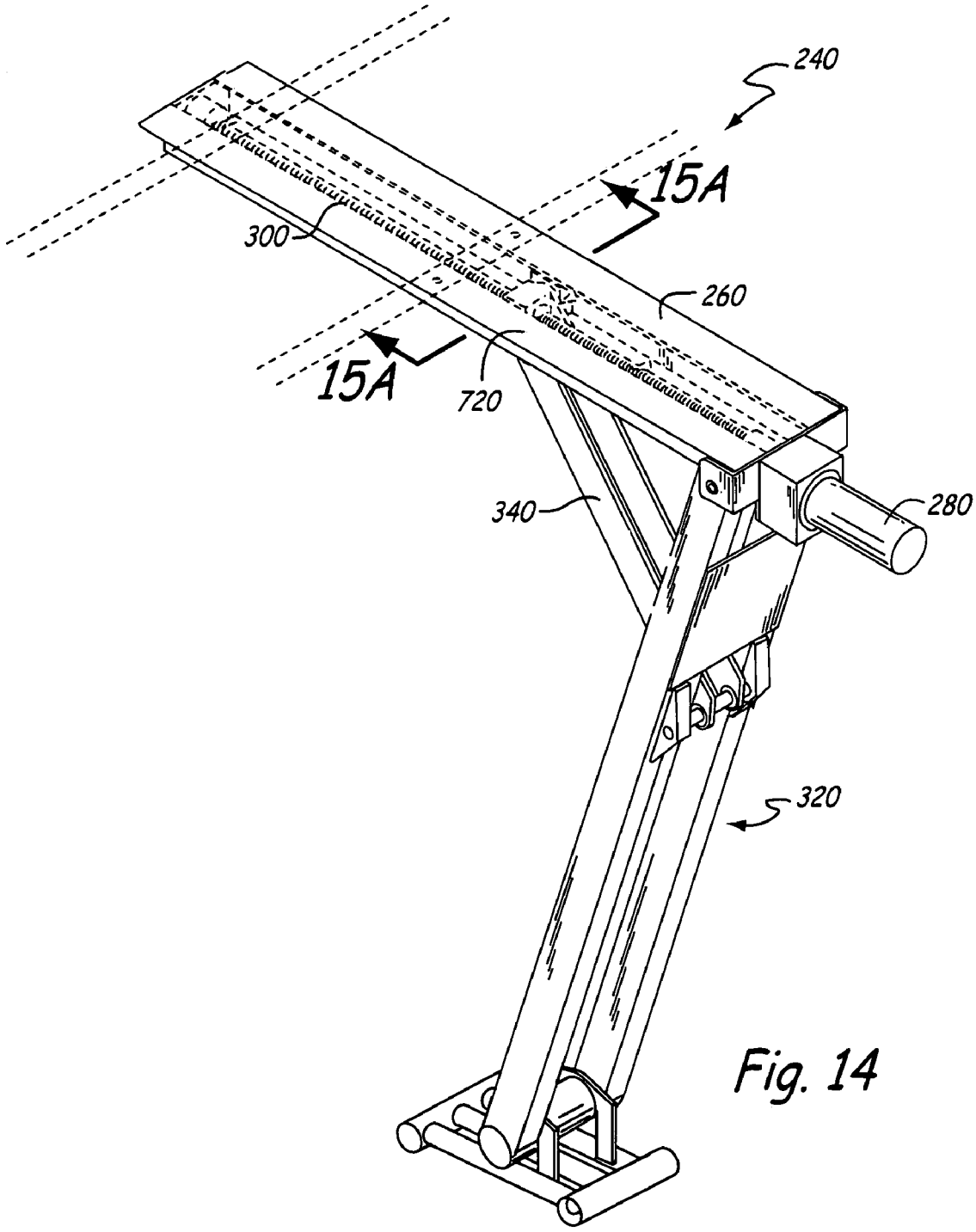
FIG. 14 is a perspective view of a second embodiment of the lift of the present invention.
Figure 15A:
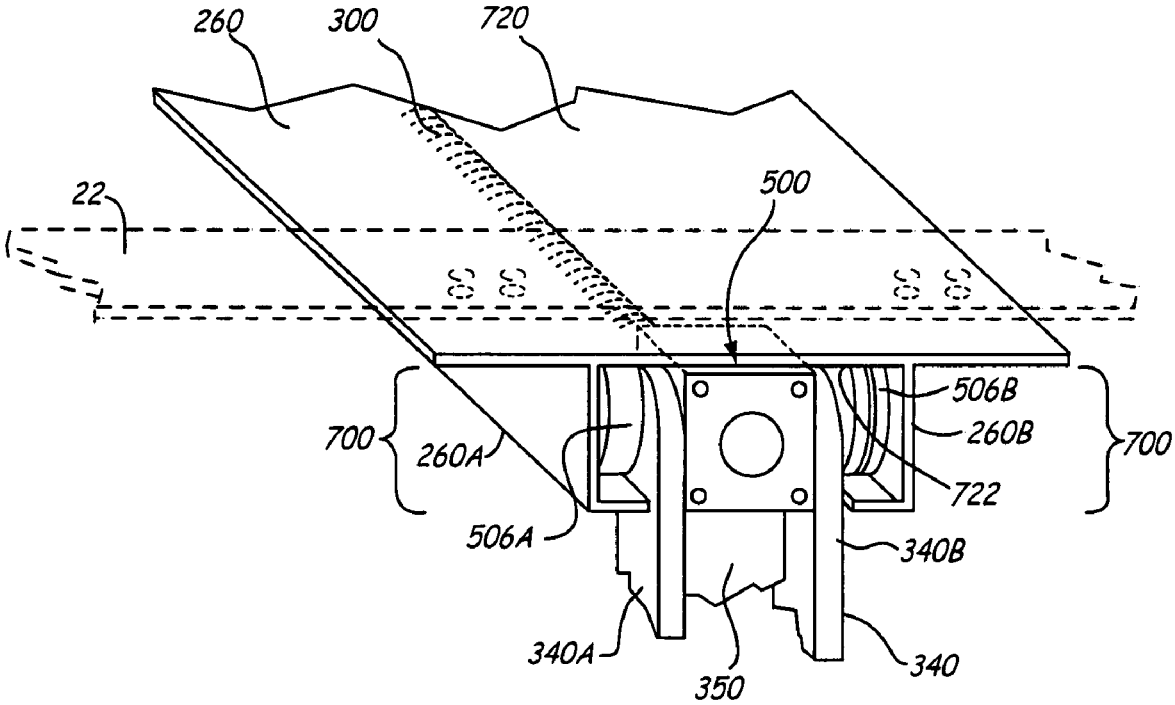
FIG. 15A is an enlarged cross-sectional view of the lift of FIG. 14 taken along line 15A-15A.
Figure 15B:
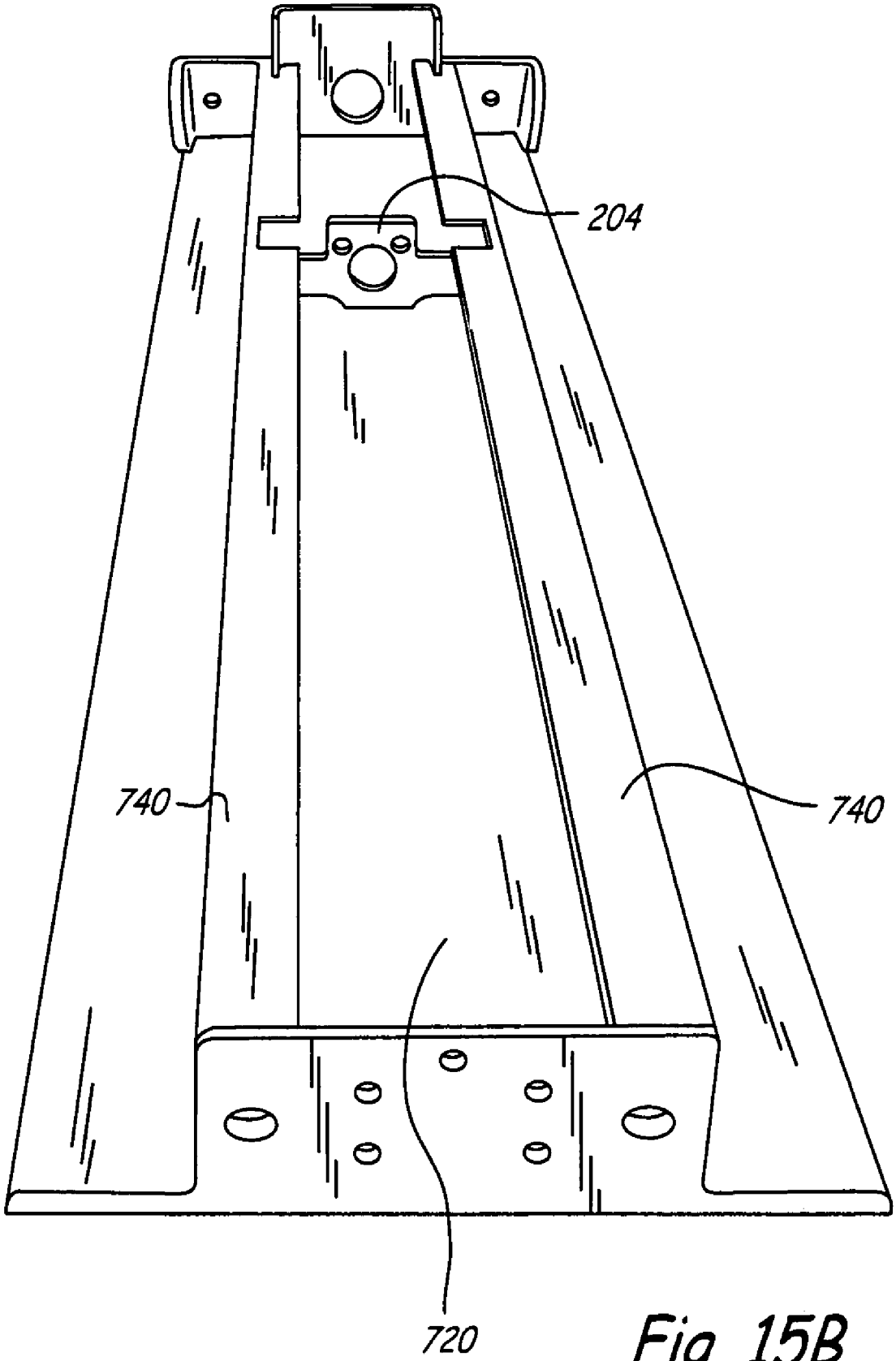
FIG. 15B is a bottom view of a channel member of the lift of FIG. 14.

FIG. 14 is a perspective view of another embodiment of lift 240. Like lift 24, lift 240 generally includes channel 260, a motor 280, a screw 300, a leg 320, and a fulcrum arm 340. In assembly and operation, lift 240 is substantially identical to that previously described for lift 24. Unlike lift 24, the channel 260 of lift 240 is formed as a single piece aluminum extrusion with the top wall 720 of each C-shaped track 700 integrally connected, as shown in FIGS. 14 and 15A. As shown in FIG. 15B, a portion of walls 740 are removed near plate 204 to introduce the threaded follower 500 into the C-shaped track 700 during assembly of lift 240.

Referring again to FIG. 15A, the fulcrum arm 340 is comprised of a unitary I-beam aluminum extrusion, with fulcrum arm members 340A and 340B interconnected by a cross wall 350 along a substantial length of the fulcrum arm 340. Fulcrum arm 340 connects at one end to a threaded follower 500 while the opposite end of fulcrum arm 34 connects to leg 320 in the manner previously described. When leg 320 is in the full up or retracted position, cross wall 350 serves to cover the screw 300 and prevent matter in the water from contacting and accumulating on the screw 300.

Figure 16:
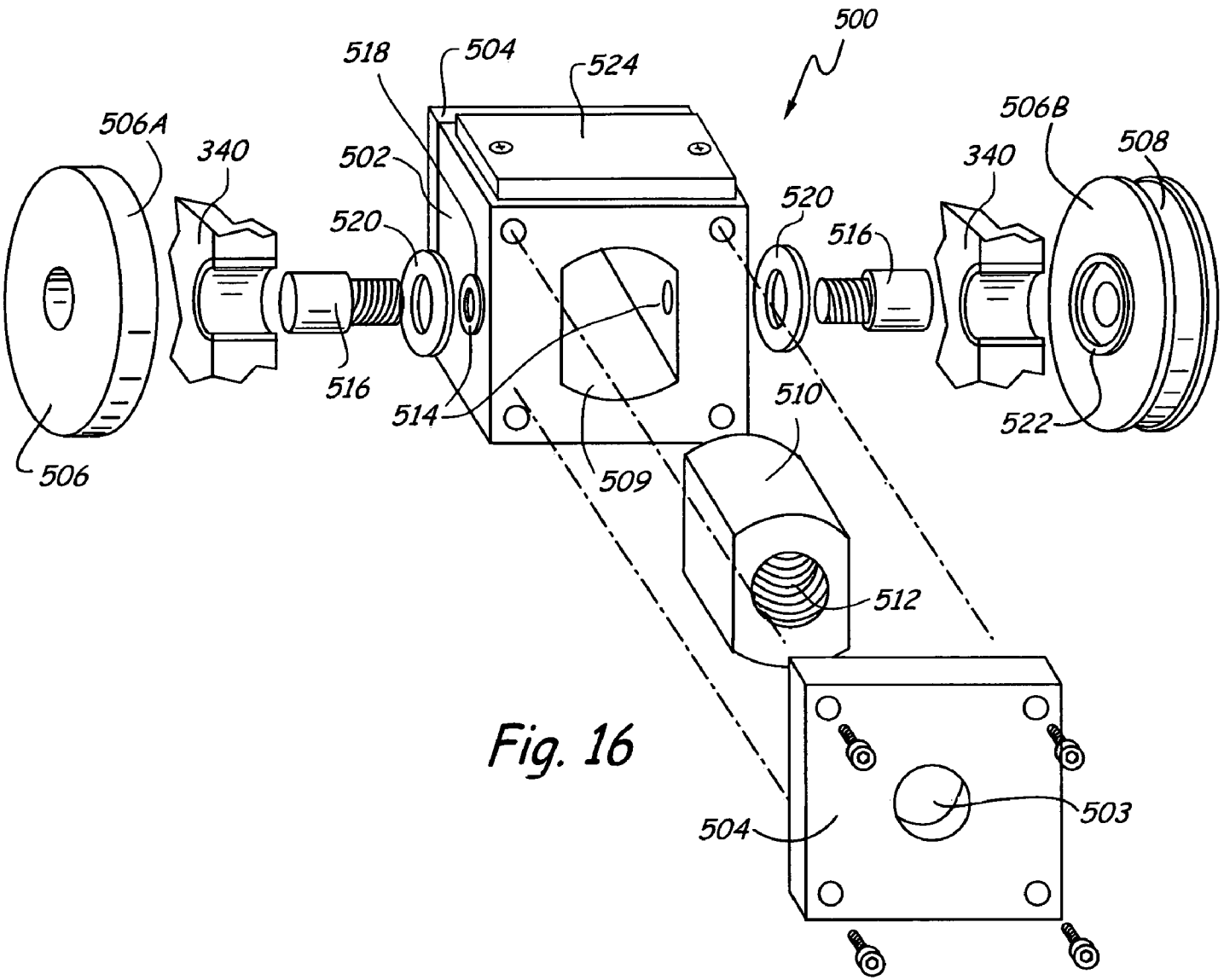
FIG. 16 is an exploded perspective view of a second embodiment of a threaded follower of the lift of the present invention.

FIG. 16 is an exploded view of threaded follower 500. Threaded follower 500 comprises a block 502 and end cover plates 504, which are secured with bolts to block 502. Each cover plate 504 is formed with a central opening 503 sized to allow screw 300 to pass through and into a threaded member 510 retained in block 502. As shown in FIGS. 15A and 16, associated with threaded follower 500 are wheels 506A, 506B, which like slider blocks 78, are sized to fit within the channel members 260A, 260B and are dimensioned to roll along C-shaped tracks 700 as threaded follower 500 moves along screw 300 to assist in smooth travel of threaded follower 500 along screw 300. Wheel 506B is fitted with a central band of a magnetic material 508 which is detected by a stop sensor in the manner previously described.

As shown in FIG. 16, block 502 is machined to include a keyed bore 509 that extends through the block in a first axial direction to closely receive a complimentary shaped threaded member 510. In one embodiment, threaded member 510 comprises a polymer body. A suitable polymer that has been tested for member 510 is the thermoplastic polymer Delrin 150, a polyoxymethylene homopolymer. Member 510 is machined with an internally threaded central bore 512 that is mateable with screw 300. The polymer body forming member 510 was evaluated after cycling lift 240 four hundred times and no discernible wear of the internal threads was detected. Member 510 is retained within block 502 by the cover plates 504, which overlap the end faces of member 510.

Extending through block 502 in a second axial direction is a threaded bore 514 which receives a pair of threaded posts 516 on opposite sides of block 502. Bore 514 is framed by a circumferential shoulder 518 extending from the respective faces of block 502. Each shoulder 518 is sized to engage a brass washer 520 positioned between block 502 and fulcrum arm 340. Threaded posts 516 support and carry wheels 506 adjacent to fulcrum arm 340. Wheels 506 include a circumferential shoulder 522 around the central opening on the surface facing fulcrum arm 340 to space wheels 506 from fulcrum arm 340 and minimize frictional contact between wheels 506 and fulcrum arm 340. One of wheels 506 (wheel 506B) has a split rim configuration to retain the magnetic strip 508 relative to wheel 506B.

A guide pad 524 formed from a polymer, such as plastic, is secured to a face of block 502 that faces the inner surface 722 of top wall 720 (FIG. 15A). Pad 524 contacts surface 722 and aids in maintaining a proper orientation of threaded follower 500 relative to surface 722.

Figure 17A:
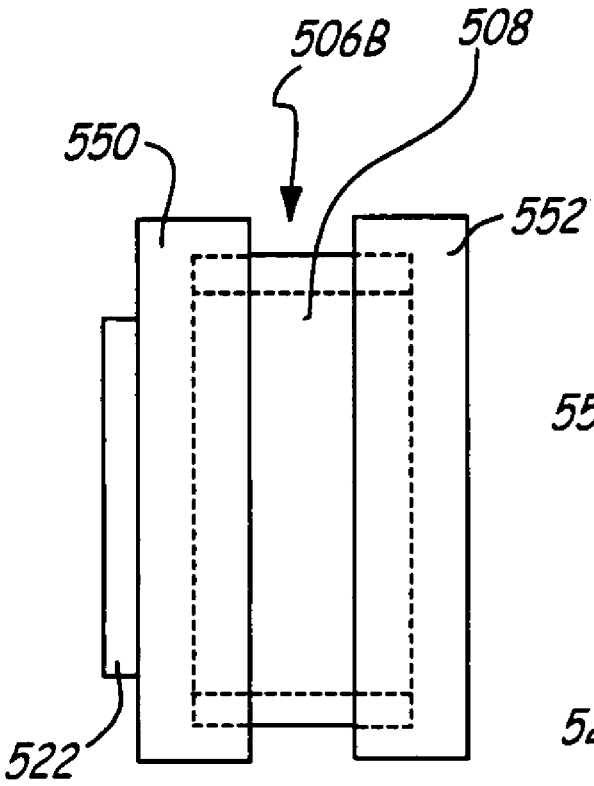
FIG. 17A is an end view of a split wheel used with the threaded follower of FIG. 16.
Figure 17B:
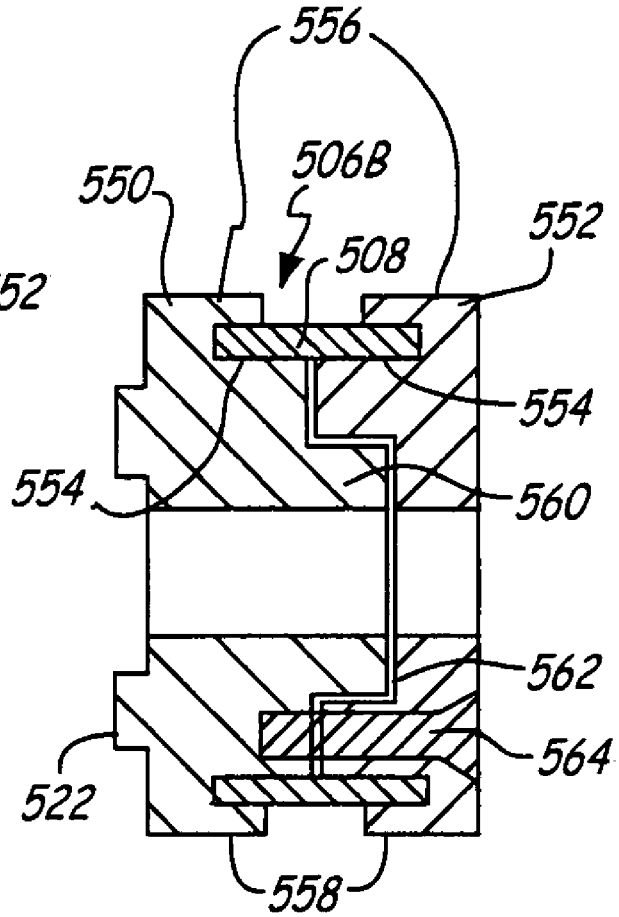
FIG. 17B is a cross-sectional view of the split wheel of FIG. 17A.

FIGS. 17A and 17B show an end view and a cross-sectional view, respectively, of wheel 506B. Wheel 506B is formed from two sections 550 and 552 which are machined to mate relative to one another and in combination define a common inner circumferential surface 554 spaced from the outer circumferential surface 556 of wheel 506B. Sections 550 and 552 are further machined to permit the inner circumferential surface 554 to be overlapped by a spaced lip 558. A strip of magnetic material 508 having a length generally equal to the circumference of the inner circumferential surface 554 and a width generally equal to the width of the inner circumferential surface 554 is retained relative to wheel 506B by the overlapped lip 558 of each section 550, 552. Section 550 includes a cylindrical extension 560 which is dimensioned to fit closely within a cylindrical recess 562 of section 552 to mate the two sections together. Sections 550 and 552 are secured relative to one another by a plurality of spaced threaded connectors 564, such as screws.

Figure 18:
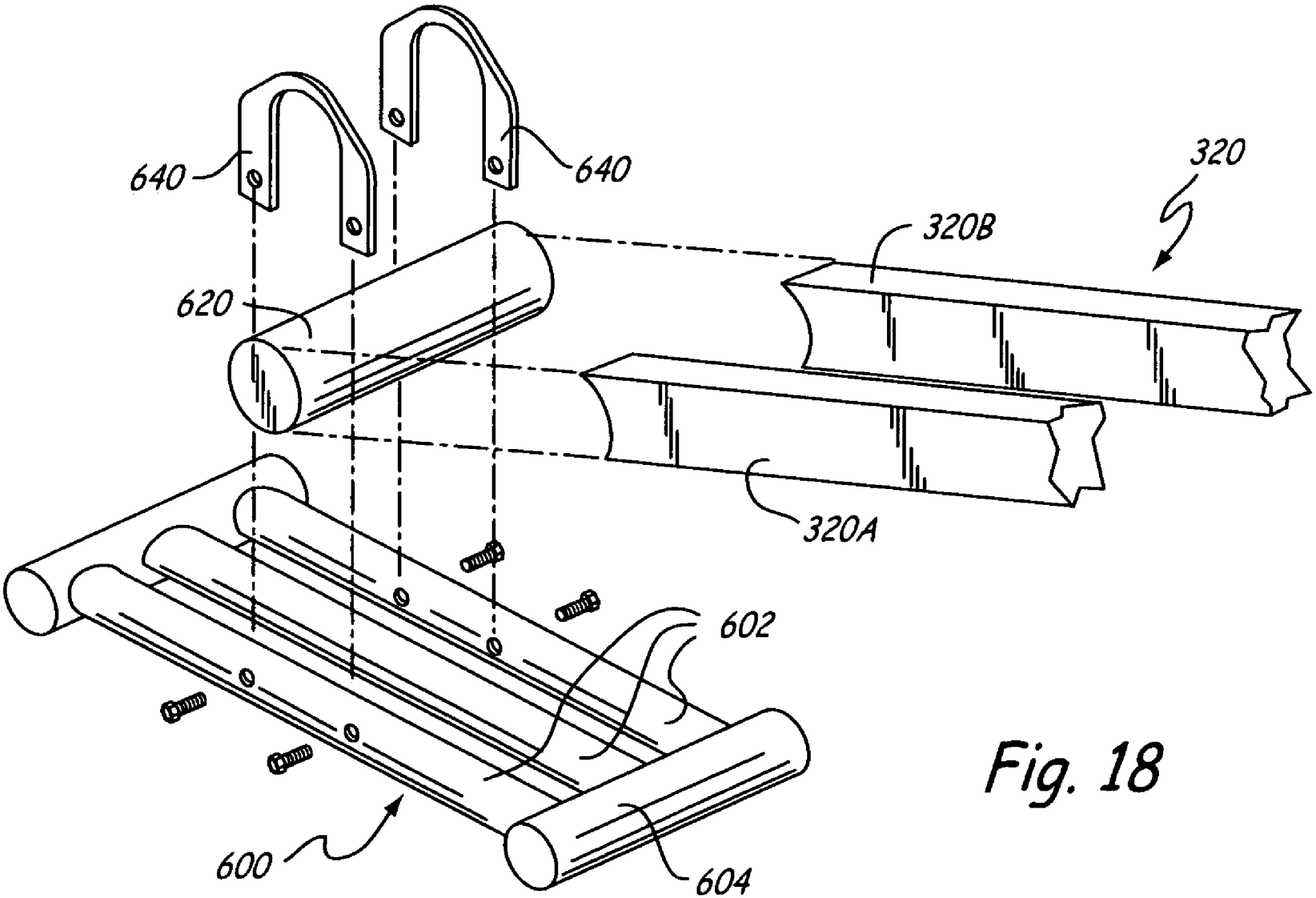
FIG. 18 is a partially exploded view of a tubular pad carried by a leg of the lift of the present invention.

FIG. 18 is an exploded view of a base pad 600 connected to an end of leg 320 to support leg 320 on the floor of a body of water. In one exemplary embodiment, base 600 attaches to a pivot tube 620 connected between leg members 320A and 320B of leg 320. As shown in FIG. 18, pad 600 is comprised of a plurality of spaced metal members 602, oriented generally transverse to pivot tube 620, and metal members 604, which are oriented generally parallel to pivot tube 620. Members 602 are connected to members 604 by welding.

In one exemplary embodiment, members 602 and 604 are sections of aluminum tubing each having an outer diameter of between about 2 to 3 inches. In the exemplary embodiment, members 602 have a length of about 17.5 inches and members 604 have a length of about 11.5 inches. Members 602 are spaced relative to one another by, for example, about 1.75 inches. As shown, members 604 are connected to the respective ends of members 602. Thus, in one embodiment, pad 600 has overall dimensions defined by a width of about 11.5 inches and a length of about 21.5 inches to about 23.5 inches. However, pad 600 has a contact surface area defined by members 602, 604 that is between about 55 percent to about 65 percent of the overall dimensions of pad 600. Alternatively, members 604 can be located above, below or between members 602 and can be located at or near the respective ends of members 602. Members 602 and 604 may be formed from non-tubular metal sections, such as angle stock or bar stock of a suitable metal, such as aluminum.

Pad 600 is pivotally connected to pivot tube 620 by a pair of U-shaped brackets 640. In one exemplary embodiment, brackets 640 are bolted to the two outer-most members 602 along an external surface facing the middle elongate tubular section 602. Brackets 640 are located along members 602 to the rear of center to ensure that the front of pad 600 is oriented toward the floor of the body of water as leg 320 is lowered, thereby allowing the front of pad 600 to contact the floor first. The spacing and dimension of members 602, 604 is selected to create a sufficient contact surface area of pad 600 to support the leg of a pontoon boat lift on the bottom of a body of water and yet allow pad 600 to easily separate from the bottom (i.e., particularly when pad has settled below the surface of the bottom) when the leg is retracted and raised to a full up and stored position. Pad 600 is also well suited as a base for a leg used to support other objects on the bottom of a body of water, such as docks, which may require periodic separation of the base pad from the bottom of a body of water.

Although the present invention has been described with reference to preferred embodiments, workers skilled in the art will recognize that changes may be made in form and detail without departing from the spirit and scope of the invention.

What is claimed is:

1. A pontoon lift system comprising:

an elongate channel having a pair of spaced C-shaped tracks, the channel comprising a top wall connecting the pair of C-shaped tracks together, the top wall defining mounting flanges for connecting the channel to an underside of a pontoon deck;

a threaded shaft rotationally mounted between the pair of C-shaped tracks and supported at first and second ends of the elongate channel;

a leg pivotally connected at one end of the elongate channel;

a threaded follower positioned between the pair of C-shaped tracks and engaging the threaded shaft, the threaded follower comprising:

a block having a central opening extending between opposing first and second sides of the block;

a threaded member having an outer surface configured to fit within the central opening, the threaded member having a bore defined between first and second ends of the threaded member, the bore configured with internal threads complimentary to the threaded shaft, the internal threads of the bore being mated with the threaded shaft, first and second end plates connected to the opposing first and second sides of the block, each of the first and second end plates configured to define an opening, the threaded shaft extending through the openings of the first and second end plates, first and second wheels mounted on posts connected to opposing third and fourth sides, respectively, of the block, the first and second wheels positioned within the pair of C-shaped tracks;

an arm having a first end connected to the leg at a point spaced from the pivotal connection of the leg to the elongate channel, the arm having a second end connected to the posts on the block third and fourth sides; and means connected to the threaded shaft for rotating the shaft, whereby the threaded follower is carried along the threaded shaft, the arm thereby causing the leg to pivot relative to the elongate channel.

2. The pontoon lift system of claim 1, wherein the first wheel comprises a circumferential groove having a first circumferential surface spaced from a second circumferential surface, the first circumferential surface having a width, the second circumferential surface defining a lip on opposite sides of the circumferential groove, a strip of magnetic material positioned within the circumferential groove between the first circumferential surface and the lips defined by the second circumferential surface, and means connected to the elongate channel for sensing the position of the magnetic strip.

3. The pontoon lift system of claim 1, wherein a portion of each C-shaped track is configured to define an opening for inserting and removing the threaded follower from the C-shaped track.

4. The pontoon lift system of claim 1 wherein the arm comprises a first arm member, a second arm member spaced from the first arm member, the first and second arms integrally connected to a cross wall member.

5. In a lift for a boat having a plurality of deck support members supporting a base of the boat, a pair of channels for connection to the plurality of deck support members, a power source located at a first end of the pair of channels, a bearing located at a second end of the pair of channels, a screw supported between the pair of channels, the screw having opposing first and second ends respectively connected to the power source and the bearing, a threaded follower located on the screw between the power source and the bearing, a leg connected to the pair of channels adjacent one of the first and second ends of the pair of channels, and a fulcrum arm connected between the threaded follower and the leg, the improvement comprising:

the threaded follower comprises:

a block having a central opening extending between opposing first and second sides of the block;

a threaded member having an outer surface configured to fit within the central opening, the threaded member having a bore defined between first and second ends of the threaded member, the bore configured with internal threads complimentary to the screw, the internal threads of the bore being mated with the screw;

first and second end plates connected to the opposing first and second sides of the block, each of the first and second end plates configured to define an opening, the screw extending through the openings of the first and second end plates; and first and second wheels mounted on posts connected to opposing third and fourth sides, respectively, of the block, the first and second wheels positioned within the pair of channels.

6. The pontoon lift system of claim 5, wherein the first wheel comprises a circumferential groove having a first circumferential surface spaced from a second circumferential surface, the first circumferential surface having a width, the second circumferential surface defining a lip on opposite sides of the circumferential groove, a strip of magnetic material positioned within the circumferential groove between the first circumferential surface and the lips defined by the second circumferential surface, and means connected to one of the pair of channels for sensing the position of the magnetic strip.

7. The pontoon lift system of claim 5, wherein a portion of each channel is configured to define an opening for inserting and removing the threaded follower from the channel.

8. The pontoon lift system of claim 5 wherein the fulcrum arm comprises a first arm member, a second arm member spaced from the first arm member, the first and second arms integrally connected to a cross wall member.

9. A threaded follower for linear travel along a rotatable threaded shaft, wherein the threaded shaft is positioned between opposing C-shaped tracks, the threaded follower comprising:

a block having a keyed central opening extending between opposing first and second sides of the block;

a threaded member having an outer surface configured to fit within the central opening, the threaded member having a bore defined between first and second ends of the threaded member, the bore configured with internal threads complimentary to the threaded shaft, the internal threads of the bore being mated with the threaded shaft;

first and second end plates connected to the opposing first and second sides of the block, each of the first and second end plates configured to define an opening, the threaded shaft extending through the openings of the first and second end plates; and first and second wheels mounted on posts connected to opposing third and fourth sides, respectively, of the block, the first and second wheels positioned within the pair of C-shaped tracks.

10. The threaded follower of claim 9 wherein the threaded follower further comprises a guide pad secured to a fifth side of the block.

11. The threaded follower of claim 9 wherein the first wheel includes a first circumferential surface in contact with one of the C-shaped tracks, a second circumferential surface spaced from the first circumferential surface, and a strip of magnetic material secured to the second circumferential surface.

* * * * *